US009697718B1

(12) United States Patent
O'Larte

(10) Patent No.: US 9,697,718 B1
(45) Date of Patent: Jul. 4, 2017

(54) ROOM PRIVACY DEVICE

(71) Applicant: CERNER INNOVATION, INC., Kansas City, KS (US)

(72) Inventor: David J. O'Larte, Peculiar, MO (US)

(73) Assignee: CERNER INNOVATION, INC., Kansas City, KS (US)

( * ) Notice: Subject to any disclaimer, the term of this patent is extended or adjusted under 35 U.S.C. 154(b) by 0 days.

(21) Appl. No.: 14/982,777

(22) Filed: Dec. 29, 2015

(51) Int. Cl.
*G08B 21/00* (2006.01)
*G08B 21/18* (2006.01)
*G10L 25/78* (2013.01)

(52) U.S. Cl.
CPC ..... *G08B 21/182* (2013.01); *G10L 25/78* (2013.01)

(58) Field of Classification Search
CPC combination set(s) only.
See application file for complete search history.

(56) References Cited

U.S. PATENT DOCUMENTS 7,095,321 B2 * 8/2006 Primm ..... G08B 13/19656 340/3.1
7,129,818 B1 * 10/2006 Begole ..... G08B 21/0469 340/286.02
8,195,618 B2 * 6/2012 Kreiner ..... G06Q 10/10 707/672
8,198,991 B2 * 6/2012 Do ..... G08B 21/06 340/426.1
8,284,041 B2 * 10/2012 Cuddihy ..... B60N 2/002 340/457
2010/0085171 A1 * 4/2010 Do ..... G08B 21/06 340/426.1
2011/0074565 A1 * 3/2011 Cuddihy ..... B60N 2/002 340/457

* cited by examiner

*Primary Examiner* — Travis Hunnings
(74) *Attorney, Agent, or Firm* — Shook, Hardy & Bacon L.L.P.

(57) ABSTRACT

A room privacy device sounds an audible alarm when a door to a room is not closed and sound is detected in the room. This helps prompt people in the room to close the door to maintain the privacy of the conversation and/or prevent sound in the room from disturbing others outside the room. In some embodiments, the room privacy device includes a door sensor for detecting whether a door is open, a microphone for capturing sound, and a speaker for providing an audible alarm. The room privacy device also includes a processor that causes the speaker to sound an audible alarm based on a signal from the door sensor indicative of the door being open and a signal from the microphone indicative of sound being detected.

20 Claims, 5 Drawing Sheets

ROOM PRIVACY DEVICE

BACKGROUND

There are a variety of scenarios in which it is important to maintain conversations in privacy. For example, HIPPA mandates that healthcare organizations take reasonable measures to protect confidential personal information. This includes conversations with physicians in their offices, hospital registration areas, nursing stations, insurance service call centers, and even the offices of human resources representatives. As another example, discussions between an attorney and client must be kept private to protect attorney-client privilege over the conversation. Often, rooms are available to allow people to have private conversations. For instance, privacy rooms are often provided in healthcare facilities, such as hospitals, and meeting rooms are often available in courthouses for attorneys to meet with their clients. Despite the availability of such rooms, some discussions are not kept private due to doors to the rooms not being closed. Accordingly, when a door to such a room is not closed, people in an adjoining area (e.g., a waiting room) may be able to overhear the conversation, thereby preventing the conversation from being kept private.

SUMMARY

Embodiments of the present invention relate to a room privacy device that sounds an audible alarm when a door to a room is not closed and sound is detected in the room. This helps prompt people in the room to close the door to maintain the privacy of the conversation and/or prevent sound in the room from disturbing others outside the room. In some embodiments, the room privacy device includes a door sensor for detecting whether a door is open, a microphone for capturing sound, and a speaker for providing an audible alarm. The room privacy device also includes a processor that causes the speaker to sound an audible alarm based on a signal from the door sensor indicative of the door being open and a signal from the microphone indicative of sound being detected. In some embodiments, sound from the microphone is analyzed and the alarm is only sounded if the sound satisfies certain criteria, such as: the sound occurring for a threshold period of time; the sound occurring at a threshold volume level, and/or the sound being recognized as human speech.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 2:
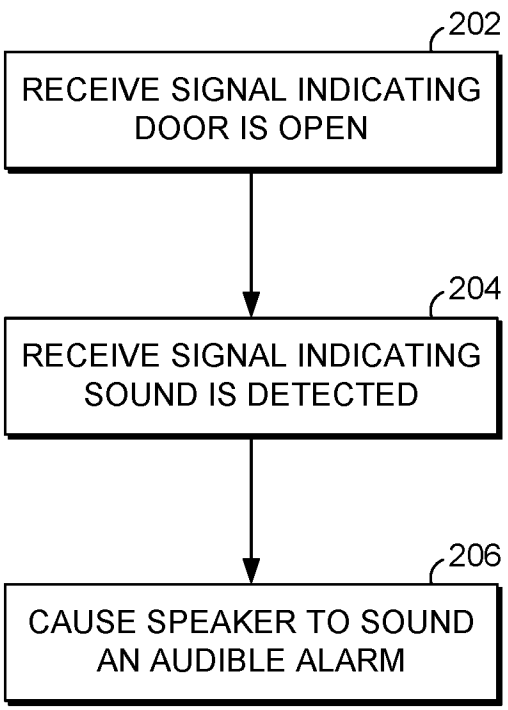
FIG. 2 is a flow diagram performed by a room privacy device to sound an alarm in accordance with an embodiment of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

With reference to the drawings, wherein like reference characters designate like parts throughout the different views, a room privacy device according to an embodiment of the present invention is designated generally with the reference numeral 10. The room privacy device 10 is generally configured to determine whether a door to a particular room is open and a sound/voice is detected. If as sound/voice is detected when the door is open, an audible alarm is triggered. By sounding an alarm, the room privacy device 10 can notify the occupants that the door is open and prompt the occupants to close the door to ensure privacy. The room privacy device 10 may be used in any of a variety of different settings, such as for instance, privacy rooms in healthcare facilities, meeting rooms in courthouses, and meeting rooms in offices, to name a few. The room privacy device 10 may be used to not only maintain the privacy of the conversation occurring in the room where it is installed but it also helps ensure that sound emanating from a room do not disturb others outside of the room. For instance, in office settings, people's work spaces are often located outside of conference rooms. As such, the room privacy device 10 could be used to prompt people in a meeting room to close a door to prevent sound in the meeting room from disturbing others outside of the meeting room.

Among other components not shown, the room privacy device 10 in one embodiment includes a door sensor 12, a microphone 14, a speaker 16, and a processor 18. Generally, the door sensor 12 is any type of electromechanical or other type of device operable to detect whether a door is open or closed. By way of example only and not limitation, the door sensor 12 may be a pair of electrical contacts positioned such that when the door is closed, the contacts touch one another to create a closed circuit, and when the door is open, the contacts are separated opening the circuit.

As another example, the door sensor 12 may be provided by a magnetic switch (e.g., a reed switch) and a magnet. The magnetic switch and magnet are positioned such that when the door is closed, the magnet is located proximate the magnetic switch and a magnetic force of the magnet either opens or closes the magnetic switch, thereby opening or closing a circuit (and vice versa when the door is open).

As still another example, the door sensor 12 may be a photoelectric transmitter and photoelectric sensor positioned such that when the door is closed the photoelectric transmitter aligns with the photoelectric sensor and a photoelectric beam transmitted by the photoelectric transmitter is sensed by the photoelectric sensor. When the door is open, the photoelectric transmitter and photoelectric sensor are not aligned such that the photoelectric beam from the photoelectric transmitter is not sensed by the photoelectric sensor.

The microphone 14 is any type of sensor that converts sound into an electrical signal. In some embodiments, the microphone 14 comprises a directional microphone that has a greater sensitivity to sounds coming from a particular area in front of it. If directional, the microphone is positioned to have a greater sensitivity to sound coming from inside the room as opposed to sound outside of the room. This helps reduce or prevent false triggers caused by sound coming from outside of the room.

The processor 18 is any type of hardware programmed to perform the functions described herein below. For instance, in some embodiments, the processor 18 is a general purpose processor executing instructions stored in memory (not shown). In other embodiments, the processor comprises a special purpose logic component. For example, and without limitation illustrative types of special purpose logic components that can be used include Field-programmable Gate Arrays (FPGAs), Application-specific Integrated Circuit (ASICs), Application-specific Standard Products (ASSPs), System-on-a-chip systems (SOCs), Complex Programmable Logic Devices (CPLDs), etc.

The processor 18 generally operates to cause the speaker 16 to sound an alarm when the door is open and sound is detected. The speaker 16 is any type of device that converts an electrical signal into sound. FIG. 2 provides a flow diagram showing a method 200 performed by the processor 18 to cause an audible alarm. As shown at block 202, the processor 18 receives a signal indicating that the door is open. The signal originates from the door sensor 12. For example, in an embodiment in which the door sensor 12 comprises a pair of electrical contacts, when the door is opened, the electrical contacts are no longer touching, thereby breaking a circuit and causing a signal to be provided to the processor 18 indicating the door is open.

At block 204, the processor 18 receives a signal indicative of sound being detected. In some embodiments, sound from the microphone 14 may be analyzed to determine whether sound is detected that triggers an alarm. In particular, in some embodiments, an alarm should be triggered by a conversation and not by ambient noises. To determine whether the sound is sufficient to trigger an alarm, in some configurations, the sound must be sustained for a threshold period of time and/or the sound must be at or above a threshold volume level. In some configurations, speech detection is employed that analyzes the sound to classify it as speech or non-speech. This may be performed, for instance, by analyzing the frequency of the sound or by employing other known speech detection/recognition techniques. Speech detection/recognition techniques able to recognize sound as spoken language are well-known and therefore will not be described in further detail herein.

Based on the signal indicating the door is open and the signal indicating that sound is detected, the processor 18 causes the speaker 16 to sound an audible alarm, as shown at block 206. Any audible sound may be provided for the alarm. In some configurations, the alarm includes a voice message, such as: "Please close door for privacy." The voice message may be provided, for instance, from a voice recording or generated from speech synthesis. In other configurations, the alarm is simply an alarm sound that does not include any voice message.

The room privacy device 10 may be configured to sound the alarm for any duration. For instance, in some configurations, the alarm continues to be sounded until the door is closed. In some configurations, the alarm is discontinued after a predetermined period of time even if the door remains open. In still further configurations, the alarm may be manually discontinued by a person. For instance, a button may be provided on the room privacy device 10 that allows a person to discontinue the alarm or the room privacy device 10 can be configured with voice recognition capabilities that allow a person to discontinue the alarm using a voice command. Such a button and/or voice recognition capabilities could also be provided to allow a person to turn off the functionality of the room privacy device 10 even in the absence of an alarm being sounded.

The components of the room privacy device 10 may be housed in a single body or the components may be distributed in accordance with various embodiments of the present invention. Additionally, the components may be installed in various locations in a room. By way of illustration only and not limitation, FIGS. 3-7 provide several examples of the room privacy device 10.

Figure 4:
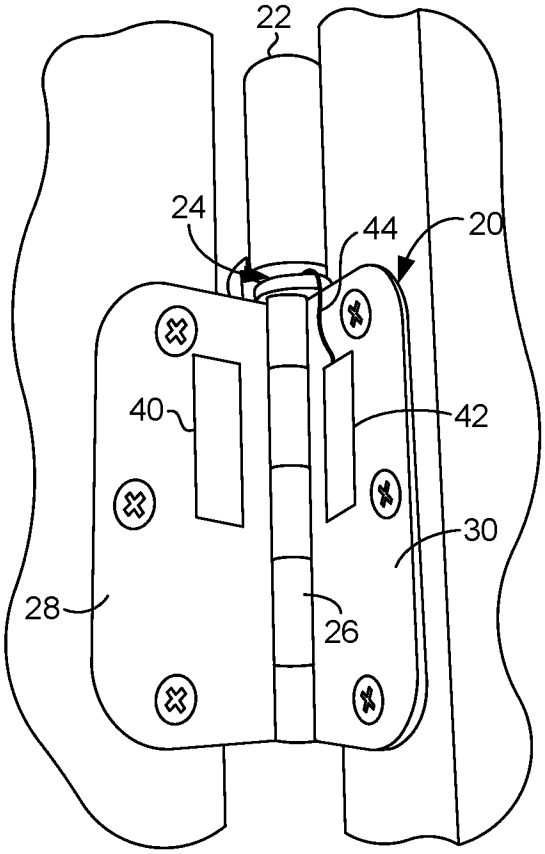
FIG. 4 is a perspective view of a room privacy device installed on a hinge of a door in accordance with another embodiment of the present invention.
Figure 3:
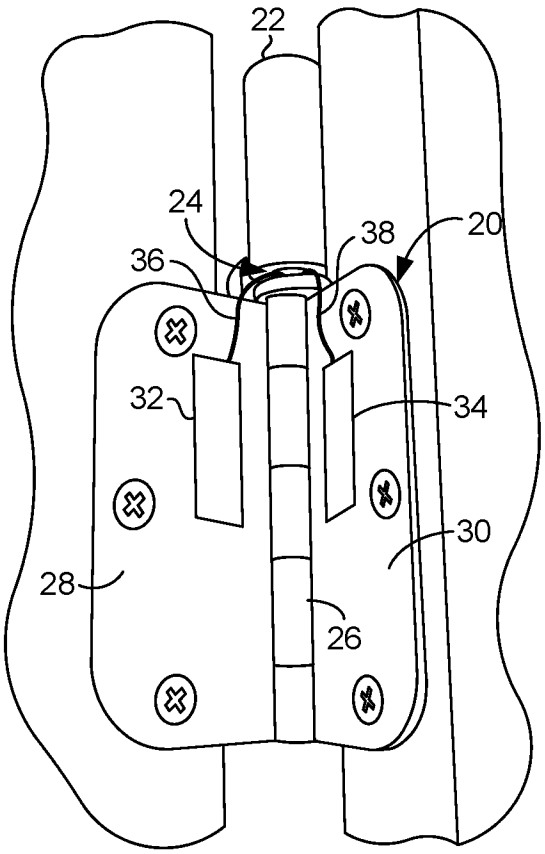
FIG. 3 is a perspective view of a room privacy device installed on a hinge of a door in accordance with an embodiment of the present invention.

Referring initially to FIGS. 3 and 4, in some embodiments, the room privacy device 10 is integrated with a door hinge 20. As shown in FIGS. 3 and 4, the room privacy device 10 includes a main body 22 located on top of a door hinge pin 24 that extends through the knuckle 26 of the door hinge 20. The main body 22 comprises an enclosure constructed from any suitable material (e.g., plastic, metal, etc.) that houses a microphone, speaker, and processor. The main body 22 may be cylindrical in shape as in FIGS. 3 and 4 or another shape in other configurations. In some configurations, the main body 22 is integral with the door hinge pin 24 in that the main body 22 is manufactured as one-piece with the door hinge pin. Alternatively, the main body 22 is configured to be attached to an existing door hinge pin 24. This facilitates retrofitting an existing door with the room privacy device 10 by either replacing a previous door hinge pin with the door hinge pin 24 having an integral main body 22 or by attaching the main body 22 to the existing door hinge pin 24.

A door sensor is located on the hinge leaves 28, 30 of the door hinge 20. In FIG. 3, the door sensor comprises a pair of electrical contacts 32, 34 that are located on the hinge leaves 28, 30 and connected to the main body 22 by wires 36, 38. As such, when the door is closed, the electrical contacts 32, 34 touch one another to create a closed circuit, and when the door is open, the electrical contacts 32, 34 no longer touch one another and the circuit is broken.

In FIG. 4, the door sensor comprises a magnet 40 located on one hinge leaf 28 and a magnetic switch 42 (e.g., a reed switch) located on the other hinge leaf 30. The magnetic switch is connected to the main body 22 by a wire 44. When the door is closed, the magnet 40 is located proximate to the magnetic switch 42, and when the door is open, the magnet 40 is located a distance from the magnetic switch 42. Accordingly, the magnetic switch 42 may be opened or closed based on the location of the magnet relative to the magnetic switch when the door is open or closed.

Figure 6:
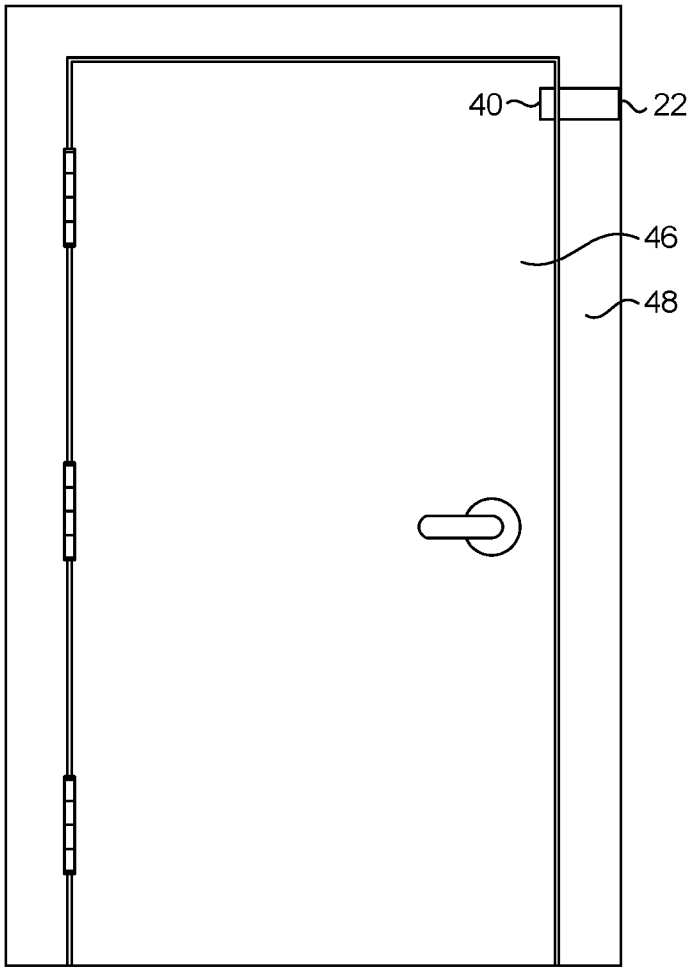
FIG. 6 is a perspective view of a room privacy device installed on the frame of a door adjacent the non-hinge side of the door in accordance with an embodiment of the present invention.
Figure 5:
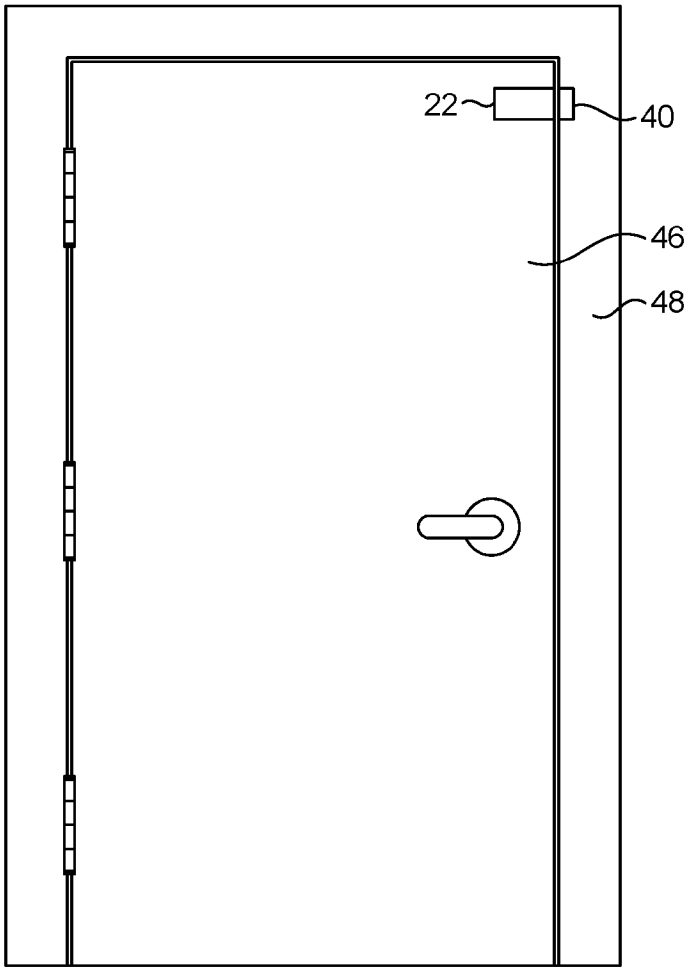
FIG. 5 is a perspective view of a room privacy device installed on the non-hinge side of a door in accordance with an embodiment of the present invention.

In other embodiments, such as that shown in FIGS. 5 and 6, the door privacy device 10 is configured to be installed on the non-hinged side of the door 46 adjacent to the door frame 48. In the embodiments shown in FIGS. 5 and 6, a main body 22 houses a microphone, speaker, and processor. Additionally, the main body 22 houses a magnetic switch that is opened or closed by the magnetic force of a magnet 40 that is provided separate from the main body 22.

As shown in FIG. 5, the main body 22 may be installed on the face of the door 46, while the magnet 40 is installed on the door frame 48. Alternatively, as shown in FIG. 6, the main body 22 may be installed on the door frame 48, while the magnet 40 is installed on the face of the door 46. In either case, the magnet 40 is proximate to the magnetic switch in the main body 22 when the door is closed and located away from the magnetic switch in the main body 22 when the door is open, thereby causing the magnetic switch to open or close based on whether the door is open or closed.

Figure 7:
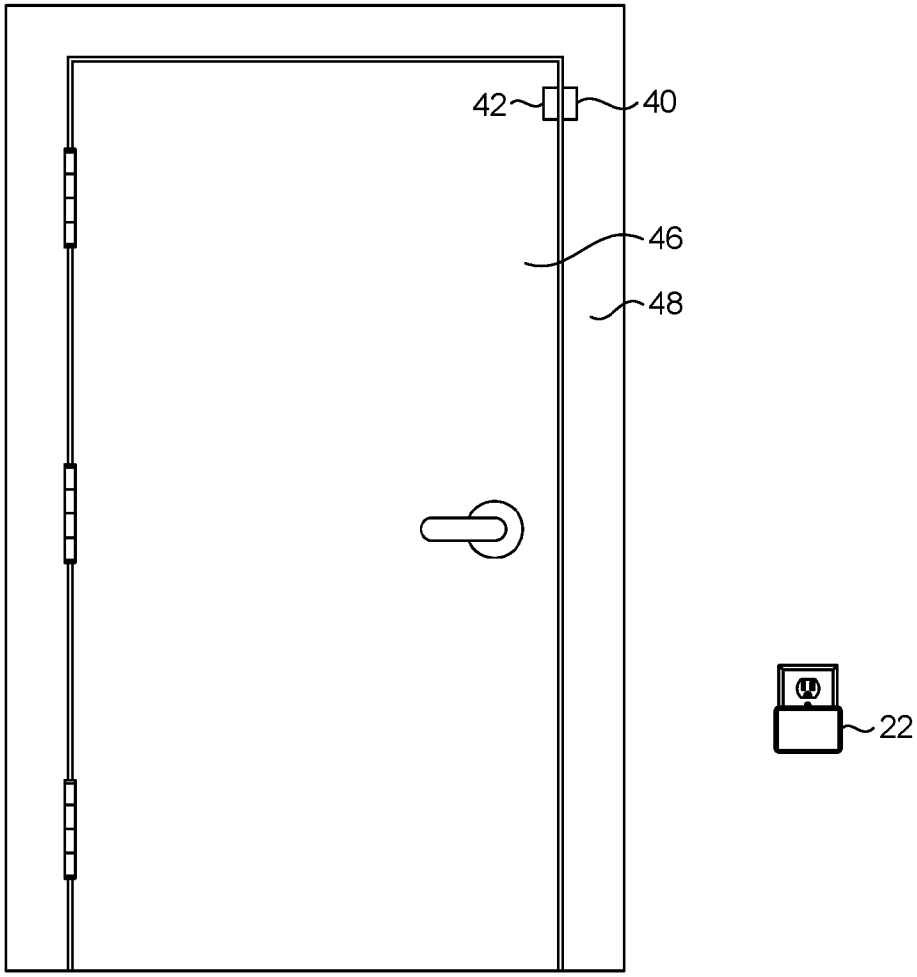
FIG. 7 is a perspective view of a room privacy device located remotely from a monitored door in accordance with an embodiment of the present invention.

In some configurations, components of the room privacy device 10 may be located remotely from other components and may communicate wirelessly using known wireless communication protocols (e.g., Bluetooth, WiFi, and Zigbee protocols). For instance, FIG. 7 illustrates a configuration in which a main body 22 is located remotely from the door 44 being monitored. In the configuration of FIG. 7, the main body 22 includes a microphone speaker, and processor. Additionally, the main body 22 includes power plugs (not shown) that allow the main body to be powered by plugging the power plugs into an outlet. A door sensor is provided by a magnet 40 on the door frame 48 and a magnetic switch 42 on the face of the door 46. Alternatively, the magnet 40 could be located on the face of the door 46, and the magnetic switch 42 could be located on the door frame 48. A transmitter (not shown) is included in the magnetic switch 42 to wirelessly communicate a signal indicating whether the door is open or closed to the main body 22, which includes a receiver (not shown) for receiving the wireless signal.

Figure 1:
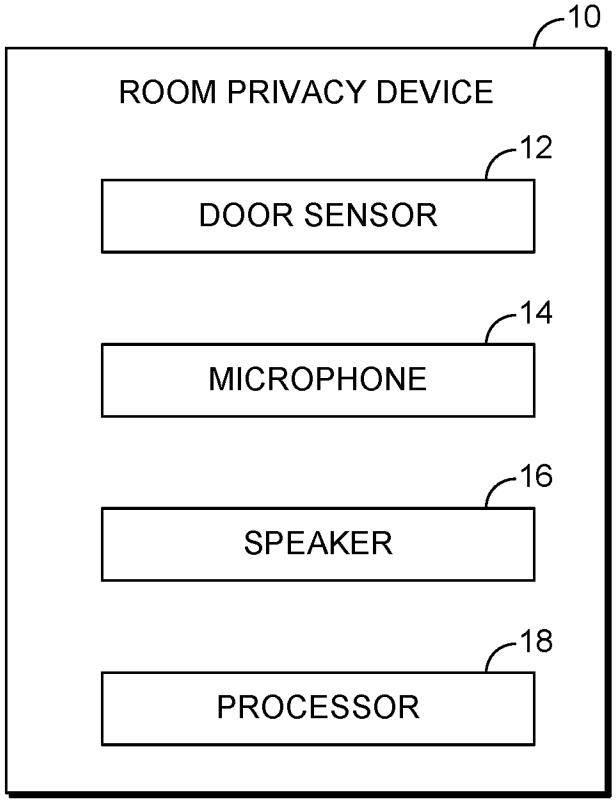
FIG. 1 is a block diagram of a room privacy device in accordance with an embodiment of the present invention.
Figure 8:
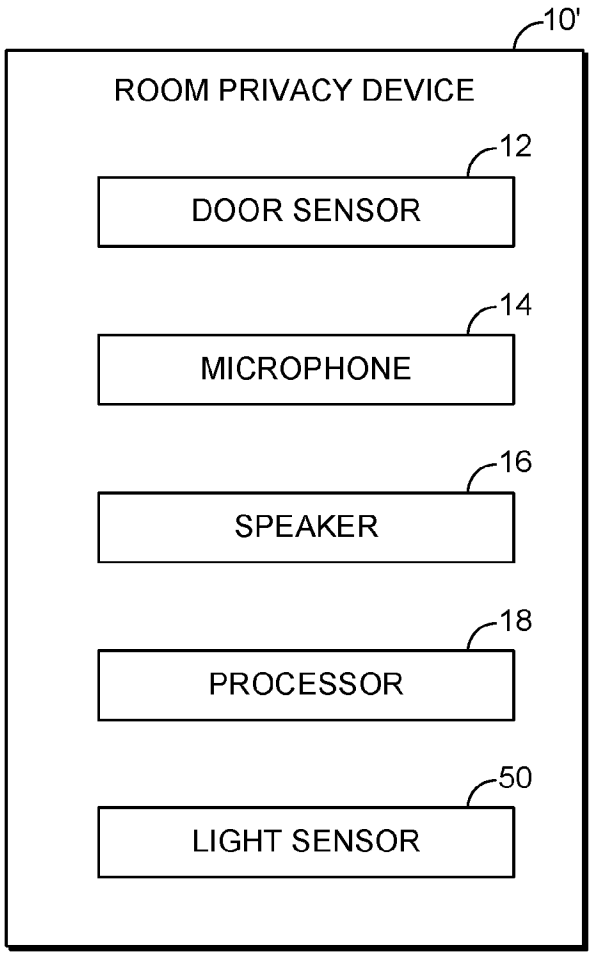
FIG. 8 is a block diagram of a room privacy device in accordance with another embodiment of the present invention.

FIG. 8 illustrates a room privacy device 10' in accordance with a further embodiment of the present invention. As shown in FIG. 8, the room privacy device 10' includes a door sensor 12, microphone 14, speaker 16, and processor 18 similar to the room privacy device 10 shown in FIG. 1. Additionally, the room privacy device 10' includes a light sensor 50 operable to detect light. The room privacy device 10' is configured to sound an audible alarm when it detects a sound/voice when a door is open and a light is detected by the light sensor 50.

Figure 9:
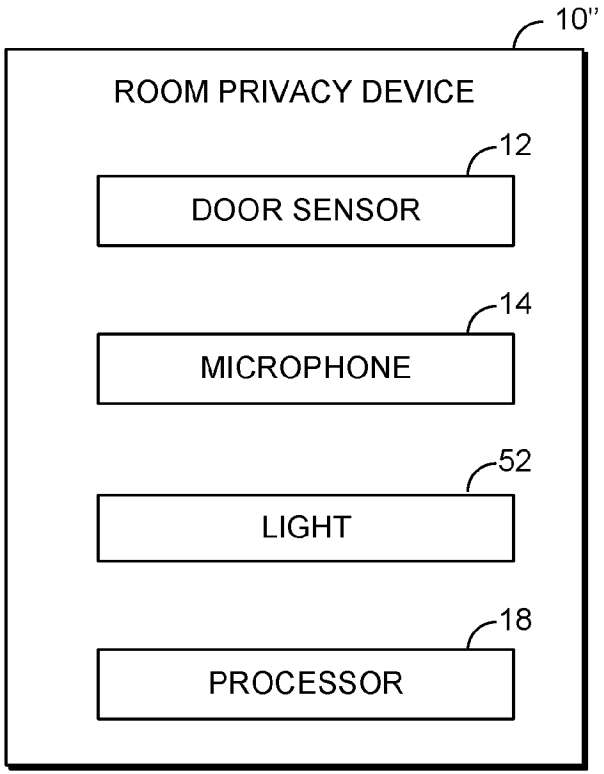
FIG. 9 is a block diagram of a room privacy device in accordance with a further embodiment of the present invention.

FIG. 9 illustrates a room privacy device 10" in accordance with still another embodiment of the present invention. As shown in FIG. 9, the room privacy device 10" includes a door sensor 12, microphone 14, and processor 18 similar to the room privacy device 10 shown in FIG. 1. However, the room privacy device 10" includes a light 52 instead of a speaker 16. The room privacy device 10" is similar to the room privacy device 10' in that it detects a door being open and sound/voice. However, the room privacy device 10" provides a visible signal using the light 52 in response to detecting sound/voice when a door is open as opposed to an audible sound provided by the speaker 16 of the room privacy device 10. The light 52 may simply turn on or the light 52 could be flashed off and on. Accordingly, the room privacy device 10" could be used, for instance, in a quiet area, flashing an annoying light rather than an audible alarm to indicate the door should be closed.

Although not shown in FIG. 9, the room privacy device 10" could also include a light sensor, such as the light sensor 50 shown in FIG. 9. In such an embodiment, the light could be triggered in response to a door being opened, sound/voice being detected, and a light sensed in the room.

In still further embodiments, as opposed to providing a light as part of the room privacy device 10" shown in FIG. 9, the room lights could be used to indicate to close a door to a room. For instance, a room privacy device could be wired to the room lights or a room privacy device could include a wireless transmitter that communicates with a wireless receiver connected to the room lights. Accordingly, in such embodiments, when a door is open and sound/voice is detected, the room privacy device could flash the room lights to indicate to close the door.

Although not shown in the figures, the room privacy devices 10, 10', 10" in some configurations include a power source, such as a battery. The room privacy devices 10, 10', 10" may also include components for charging the battery. For instance, solar cells could be provided to charge an integrated battery. As another example, a battery could be charged using the opening and closing of the door (e.g., similar to a self-winding watch).

In some embodiments, the room privacy devices 10, 10', 10" can be scheduled to be on (i.e., alarms triggered) during certain time periods and off (i.e., no alarms triggered) for other time periods. For instance, the room privacy devices 10, 10', 10" can be scheduled to be on only during office hours.

In further configurations, multiple room privacy devices may be paired together, for instance, for rooms that have multiple doors. For example, a door sensor may be placed on each door to detect when a corresponding door is opened. Each door sensor could then communicate with a main body for the room privacy device that houses a microphone, a speaker, and a processor. Accordingly, the speaker may sound an alarm when any of the doors are opened and sound is detected.

The room privacy devices 10, 10', 10" may also be used to track information in some embodiments. For instance, information could be tracked about alarm instances, such as the number of alarm instances occurring over a given time period and/or a day/time of each alarm instance. The room privacy device 10/10'/10" could also be used to detect and track room usage. For instance, in some embodiments, the microphone could be used to determine when conversations are occurring in a room. Additionally or alternatively, a light sensor could be used to determine when the room's light is turned on. Accordingly, information could be recorded identifying times and durations of voices being detected and/or the room's lights turned on.

Accordingly, in one aspect, an embodiment of the present invention is directed to device for providing a room privacy alarm. The devices includes a door sensor; a microphone; a speaker; and a processor configured to receive a first signal from the door sensor, receive a second signal from the microphone, and cause the speaker to sound an audible alarm in response to receiving the first signal and the second signal.

In another embodiment, an aspect is directed to a device for providing a room privacy alarm. The device includes a door sensor; a microphone; a speaker; and a processor configured to cause the speaker to sound an audible alarm in response to determining a door is open based on a first signal from the door sensor and identifying human speech based on a second signal from the microphone.

A further embodiment is directed to a device for providing a room privacy alarm. The device includes a door sensor; a microphone; a light sensor; a speaker; and a processor configured to receive a first signal from the door sensor, receive a second signal from on the microphone, a third signal from the light sensor, and cause the speaker to sound an audible alarm in response to receiving the first signal, second signal, and third signal.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

While specific elements and/or steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

The invention claimed is:

1. A device for providing a room privacy alarm, the device comprising:

a door sensor;

a microphone;

a speaker;

a processor configured to receive a first signal from the door sensor, receive a second signal from the microphone, and cause the speaker to sound an audible alarm in response to receiving the first signal and the second signal; and a main body having an enclosure that houses the microphone, the speaker, and the processor, wherein the main body is integral with a door hinge pin.

2. The device of claim 1, wherein the door sensor comprises at least one selected from the following: two electrical contacts; a magnetic switch and a magnet; and a photoelectric sensor and photoelectric transmitter.

3. The device of claim 1, wherein the microphone comprises a directional microphone.

4. The device of claim 1, wherein the door sensor is not housed by the enclosure.

5. The device of claim 4, wherein the door sensor includes a transmitter that wirelessly communicates with a receiver in the main body.

6. The device of claim 1, wherein the processor causes the speaker to sound the audible alarm when the second signal is indicative of a sound being detected using the microphone for a predetermined period of time.

7. The device of claim 1, wherein the processor causes the speaker to sound the audible alarm when the second signal is indicative of a sound being detected using the microphone having a volume that satisfies a threshold volume level.

8. The device of claim 1, wherein the processor causes the speaker to sound the audible alarm when the second signal is indicative of a sound being detected using the microphone that is determined to comprise human speech.

9. A device for providing a room privacy alarm, the device comprising:

a door sensor;

a microphone;

a speaker;

a processor configured to receive a first signal from the door sensor, receive a second signal from the microphone, and cause the speaker to sound an audible alarm in response to receiving the first signal and the second signal; and a main body having an enclosure that houses the microphone, the speaker, and the processor, wherein the door sensor comprises a magnetic switch, and the enclosure houses the magnetic switch.

10. The device of claim 9, wherein the processor causes the speaker to sound the audible alarm when the second signal is indicative of a sound being detected using the microphone for a predetermined period of time.

11. The device of claim 9, wherein the processor causes the speaker to sound the audible alarm when the second signal is indicative of a sound being detected using the microphone having a volume that satisfies a threshold volume level.

12. The device of claim 9, wherein the processor causes the speaker to sound the audible alarm when the second signal is indicative of a sound being detected using the microphone that is determined to comprise human speech.

13. A device for providing a room privacy alarm, the device comprising:

a door sensor;

a microphone;

a speaker;

a processor configured to receive a first signal from the door sensor, receive a second signal from the microphone, and cause the speaker to sound an audible alarm in response to receiving the first signal and the second signal; and a main body having an enclosure that houses the microphone, the speaker, and the processor, wherein the door sensor is not housed by the enclosure.

14. The device of claim 13, wherein the door sensor comprises at least one selected from the following: a pair of electrical contacts; a magnetic switch and a magnet; and a photoelectric sensor and photoelectric transmitter.

15. The device of claim 13, wherein the microphone comprises a directional microphone.

16. The device of claim 13, wherein the door sensor includes a transmitter that wirelessly communicates with a receiver in the main body.

17. The device of claim 13, wherein the processor causes the speaker to sound the audible alarm when the second signal is indicative of a sound being detected using the microphone for a predetermined period of time.

18. The device of claim 13, wherein the processor causes the speaker to sound the audible alarm when the second signal is indicative of a sound being detected using the microphone having a volume that satisfies a threshold volume level.

19. The device of claim 13, wherein the processor causes the speaker to sound the audible alarm when the second signal is indicative of a sound being detected using the microphone that is determined to comprise human speech.

20. The device of claim 13, wherein the processor causes the speaker to sound the audible alarm in response to determining a door is open based on the first signal from the door sensor.

* * * * *